US005846445A

United States Patent [19]

Umino

[11] Patent Number: 5,846,445

[45] Date of Patent: Dec. 8, 1998

[54] METHOD AND APPARATUS FOR TRANSFERRING MOLTEN METAL

[75] Inventor: Kaoru Umino, Yokohama, Japan

[73] Assignee: Ariake Ceramic Constructions Co., Ltd., Atsugi, Japan

[21] Appl. No.: 734,198

[22] Filed: Oct. 21, 1996

[30] Foreign Application Priority Data

Jun. 12, 1996 [JP] Japan ..... 8-151042

[51] Int. Cl.[6] ..... B22D 37/00

[52] U.S. Cl. ..... 222/590; 222/595; 266/45; 266/239

[58] Field of Search ..... 222/590, 595; 266/239, 45

[56] References Cited

U.S. PATENT DOCUMENTS

| | | | |
|---|---|---|---|
| 2,846,740 | 8/1958 | Edstrand | 222/595 |
| 3,876,191 | 4/1975 | Lauerdorf | 166/239 |
| 4,425,932 | 1/1984 | Herman | 222/590 |
| 5,190,674 | 3/1993 | Monks | 222/595 |

*Primary Examiner*—John Sheehan
*Attorney, Agent, or Firm*—Wenderoth, Lind & Ponack, L.L.P.

[57] ABSTRACT

By a method that may be used for transferring molten metal by using pressurized gas, molten metal in a metal furnace is automatically sucked into a molten metal chamber installed within the metal furnace through a fluid suction pipe by a balanced pressure inside the chamber. Then, when the molten metal sucked into the chamber is transferred to a specified position through a fluid feed pipe by applying a pressurized gas from an upper part of the chamber, the flow rate of the molten metal at the junction part between the fluid suction pipe and feed pipe or at the opposed part of an open end of the fluid suction pipe against that of the fluid feed pipe is accelerated, creating a higher flow rate at other parts of the fluid feed pipe. A molten metal transfer apparatus includes a molten metal chamber installed in a metal furnace and having a tightly closed upper part. The molten metal chamber is connected with an inlet/outlet pipe for pressurized gas and the lower part of the chamber is connected with a base part of a fluid feed pipe. In the vicinity of the base part of the fluid feed pipe, a fluid suction pipe is connected, and the other end is opened at the lower part of the metal furnace, and the cross-sectional area of the fluid feed pipe at the junction between the suction pipe and the feed pipe is contracted so as to be smaller than that at other parts of the feed pipe.

12 Claims, 7 Drawing Sheets

METHOD AND APPARATUS FOR TRANSFERRING MOLTEN METAL

BACKGROUND OF THE INVENTION

1. Field of the Invention

The present invention relates to a method and apparatus that are directed toward the automatic transfer of molten metal by a sole means of feeding and sucking gas.

2. Description of the Prior Art

Heretofore, many structures of the fluid pump have been used for the transfer of fluids by means of feeding and sucking gas. Also, a jet pump equipped with a venturi tube has been well-known.

Many types of the foregoing conventional fluid pump have adopted a system in which operations of sucking and ejecting are preformed by using different pipes equipped with an inlet/outlet valve to suck the fluid into the storing chamber at reduced pressure and to eject the fluid by feeding a pressurized gas. Provided that such kinds of conventional fluid pumps are used for transferring molten metal, an U-shape tube and the like are required because the usual valve can not be used so that the molten metal in the U-shape tube is used as an alternative of the usual valve. Also, depending upon features of the conventional fluid pumps, it is impossible to transfer a fluid continuously so that the discontinuous or intermittent transfer with limited quantity was problematic.

The jet pump is available for the continuous transfer of common fluid such as water, but practically speaking is not available for molten metal.

SUMMARY OF THE INVENTION

The present invention resolves the problems described above in connection with the prior art. The balance of the pressure between the pressure, which is applied into a molten metal chamber when the molten metal is transferred from the molten metal chamber through a fluid feed pipe, and the pressure of the inside of a fluid suction pipe, which is used for sucking the molten metal from a metal furnace to the molten metal chamber, is controlled by using an accelerated transferring flow of the molten metal at the junction between the fluid feed pipe and the fluid suction pipe or at the opposed part of an open end of the fluid feed pipe against an open end of the fluid suction pipe, so that backflow of the molten metal toward the fluid suction pipe is reduced or prevented.

Namely, the present invention is characterized in a method for transferring the molten metal by pressurized gas, wherein the molten metal in the metal furnace is sucked automatically by the pressure balance toward a molten metal chamber, which is installed in the metal furnace, through the fluid suction pipe connected to the base part of the fluid feed pipe, which is connected to the lower part of the molten metal chamber. Then the molten metal, which has been sucked into the molten metal chamber, is transferred to a specified position through the fluid feed pipe by feeding a pressurized gas from the upper part of the molten metal chamber. In a preferred embodiment of the method, the flow rate of the molten metal at the junction part between the fluid feed pipe and the fluid suction pipe while transferring the molten metal becomes higher than that at other parts of the fluid feed pipe.

In a further preferred embodiment of the method, a part of the molten metal in the metal furnace is taken into the molten metal chamber. Then the molten metal in the molten metal chamber is transferred by means of a balanced pressure in the molten metal chamber. The method for transferring the molten metal is characterized in arranging an open end of the fluid suction pipe located underneath the molten metal chamber to be opposed against an open end of the fluid feed pipe in the molten metal chamber. In the foregoing arrangement, the open end of the fluid suction pipe can be located at a level equivalent with the open end of the fluid feed pipe or the fluid suction pipe can be inserted into the fluid feed pipe.

The present invention is characterized in the apparatus for transferring the molten metal, wherein a molten metal chamber is installed in a metal furnace, whose tightly closed upper part is connected to an inlet/outlet pipe of the pressurized gas. The lower part of the molten metal chamber is connected to the base part of a fluid feed pipe, and an open end of a fluid suction pipe is directed toward the transfer direction of the molten metal inside the fluid feed pipe and connected in the vicinity of the base part of the said fluid feed pipe, and another end of the fluid suction pipe is opened underneath the metal furnace. In the previous description, the molten metal chamber can be installed, being embedded in a wall of the metal furnace or dipped into the molten metal in a metal furnace, or be installed independently from the metal furnace. Also, the connection of the fluid suction pipe to the fluid feed pipe may be arranged such that an obtuse angle is formed between them against the direction of transferring the molten metal inside the fluid feed pipe. Furthermore, a cross-sectional area of the fluid feed pipe at the junction part between the fluid suction pipe and the fluid feed pipe may be smaller than of other parts at the fluid feed pipe in order to cause a venturi effect at the junction part. The inner diameter of the fluid suction pipe may be equivalent or less than that of the fluid feed pipe.

In a further preferred embodiment, another apparatus for transferring the molten metal is characterized in that a fluid suction pipe is installed projecting on the lower part of a molten metal chamber being dipped, in parallel, or embedded in the wall of a metal furnace. An open end of the fluid suction pipe is allocated in an opposed direction against an open end of a fluid feed pipe inside the tightly closed molten metal chamber whose upper part is connected with an inlet/outlet pipe of pressurized gas. In the above description, an open end of a fluid suction pipe is located at the same level with an open end of a fluid feed pipe or is inserted into an open end of the fluid feed pipe. Also, an open end of a fluid suction pipe has a smaller cross-sectional area, preferably a half or less, than that of a fluid feed pipe.

In the above description, provided that the bottom of the metal furnace and the top end of the fluid feed pipe are kept at almost the same level, a continuous transfer can be accomplished after the transfer of the molten metal from the molten metal chamber through the fluid feed pipe has been commenced, as long as some molten metal remains inside the metal furnace and the pressure in the molten metal chamber is maintained at almost equal with atmospheric pressure or the pressure in the metal furnace.

Therefore, either way of the intermittent transfer with fixed quantity or a predetermined quantity via and through the molten metal chamber, namely, metal furnace—fluid suction pipe—molten metal chamber, and then molten metal chamber—fluid feed pipe, and the continuous transfer from metal furnace through suction pipe—feed pipe, after a transfer from molten metal chamber through fluid feed pipe has been commenced, is possible. It is a feature of the present invention regarding the apparatus, not expected in the conventional molten metal pump.

According to the present invention, in the case for transferring molten metal by pressurized gas, a molten metal chamber is installed in a metal furnace, due to balanced pressure in a molten metal chamber, molten metal in a metal furnace is automatically sucked through a fluid suction pipe connected to the base part of a fluid feed pipe, whose base part is connected to the lower part of the molten metal chamber. Then, when the molten metal, which has been sucked into the chamber, is transferred through the feed pipe to a specified position by pressurizing the chamber, a flow of the molten metal induced by transferring the molten metal, particularly an accelerated flow rate of the molten metal at the junction part between the fluid suction pipe and the fluid feed pipe, can maintain a balance between the pressure to be applied into the molten metal chamber and the pressure in the fluid suction pipe, so that a backflow of the molten metal toward the fluid suction pipe may be reduced or prevented. The present invention can also reduce or prevent the backflow, in the case for transferring molten metal, which was sucked into the molten metal chamber, to a specific position through a fluid feed pipe. An open end of the fluid suction pipe, inserted into the lower part of the chamber from a metal furnace, is located in an opposed direction against a large open end of the fluid feed pipe within the chamber. Thus, a flow of the molten metal induced by transferring the molten metal, particularly an accelerated flow rate of the molten metal at the opposed part of the open end of the fluid suction pipe against that of the fluid feed pipe, can maintain a balance between the pressure of the inside of molten metal chamber, which is applied for causing transfer flow of molten metal, and the pressure in the fluid suction pipe, so that a backflow of the molten metal toward the fluid suction pipe is reduced or prevented.

Applying such a process, the molten metal which has been stored in the molten metal chamber is transferred to a specific position through the fluid feed pipe by adding pressure on the chamber and backflow of the molten metal toward the fluid suction pipe can be reduced or prevented. Also after transfer of the molten metal from the molten metal chamber through the fluid feed pipe has commenced, a flow of the molten metal at the junction part between the fluid feed pipe and suction pipe or at the opposed part of open ends of these pipes enables the molten metal to transfer from the metal furnace through the fluid suction pipe, so that the continuous transfer from the metal furnace through the suction pipe and feed pipe is achievable.

Otherwise, automatic suction of the molten metal from the metal furnace to the molten metal chamber may be achieved by only controlling the pressure inside the molten metal chamber to be atmospheric pressure or the pressure same as that inside the metal furnace. Therefore, as well as the continuous transfer (metal furnace—suction pipe—feed pipe) as the before described, an intermittent transfer with specific quantity or predetermined quantity of molten metal using the automatic suction of the molten metal from metal furnace to molten metal chamber, namely, metal furnace—suction pipe—molten metal chamber and then molten metal chamber—feed pipe, may be also achieved.

An advantage of the present invention is that the molten metal can be transferred and taken out from the metal furnace through the feed pipe by supplying the pressurized gas into the molten metal chamber. Also, the molten metal can be entered into the molten metal chamber from the metal furnace through the suction pipe automatically by reverting the pressure level inside the molten metal chamber to atmospheric pressure or the pressure inside the metal furnace.

Since the restriction imposed on installation of the fluid suction pipe has been largely improved by positing an open end of the fluid suction pipe, which is installed at the lower part of the molten metal chamber, towards an open end of the fluid feed pipe, a further advantage of the present invention is that large quantities of the molten metal can be continuously or intermittently transferred.

A still further advantage is that the molten metal is continuously transferred by using a siphon action provided that the top part of the fluid feed pipe in the transfer direction is disposed at a level which is lower than the upper surface of molten metal in the metal furnace.

DESCRIPTION OF THE PREFERRED EMBODIMENTS

EXAMPLE 1

Inside a metal furnace 1, a molten metal chamber 2 is installed. The base end of a fluid feed pipe 3 is connected to a bottom part of the molten metal chamber 2, and another end of the fluid feed pipe 3, spanning over an upper part of the metal furnace 1, is led to a specific position. In this case, provided that continuous transfer of the molten metal is preferable, after the transfer of the molten metal from the molten metal chamber 2 through the fluid feed pipe 3 has been commenced, by locating a bottom part of the metal furnace 1 and a top end of the fluid feed pipe 3 at the nearly same level (indicated by a dotted line in FIG. 1 ), the continuous transfer of a molten metal from a metal furnace 1 through the fluid suction pipe 4 and the fluid feed pipe 3 is realized as long as some molten metal remains in the metal furnace 1.

Figure 1:
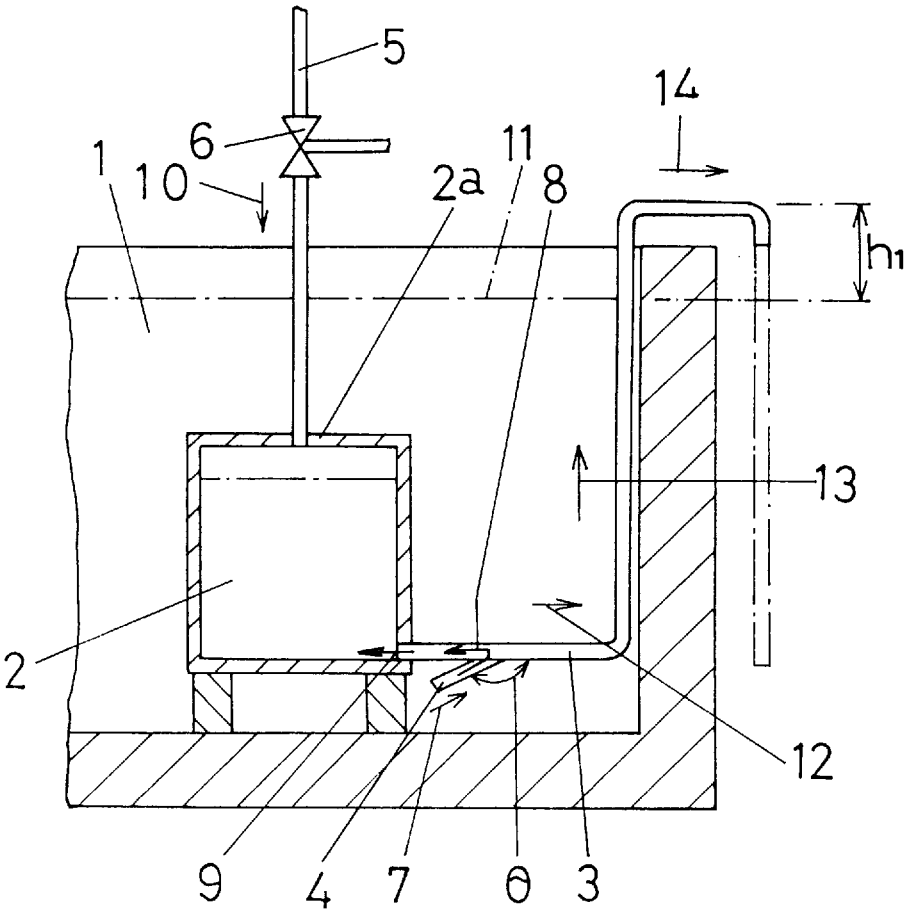
FIG. 1 is a sectional view illustrating a first embodiment of the present invention.

The top end of the fluid suction pipe 4 is connected to the base part of the fluid feed pipe 3 with an obtuse angle θ (e.g. at an angle of 145°) against the transferring direction (indicated by an arrow 12) as shown in FIG. 1. Although no special restriction is imposed for this angle θ, it is at least desirable that an open end of the fluid suction pipe is directed toward the direction of the transferring molten metal (indicated by an arrow 12).

The upper part of the molten metal chamber 2 is tightly closed and a gas inlet/outlet pipe 5 equipped with an automatic valve 6 is connected to the upper wall 2*a*. The foregoing automatic valve 6 is used for feeding and ejecting the pressurized gas. When the pressurized gas is fed, the molten metal is transferred from the molten metal chamber 2 to the specific position through the fluid feed pipe 3, and when the pressurized gas is ejected, the molten metal is fed from the metal furnace 1 to the molten metal chamber 2 through the fluid suction pipe 4.

Namely, by opening the automatic valve 6 to eject the pressurized gas outwards, the pressure inside the molten metal chamber 2 is reduced to atmospheric pressure and consequently the molten metal driven by the pressure itself inside the furnace flows into the molten metal chamber 2 through the fluid suction pipe 4 and the fluid feed pipe 3 as indicated by arrows 7, 8 and 9. Although this flow rate varies depending upon the fluid level height, it is usually controlled aiming at around a half of the molten metal transfer rate.

In the description above, correct quantity of the sucked molten metal is not known but, as far as a small variation of the fluid level 11 is concerned, the quantity in the molten metal chamber 2 can be controlled by adjusting the release time of the automatic valve 6. However, since the inlet/outlet pipe 5 projects far out of the fluid level and the automatic valve 6 is mounted on the projecting part, overflow of the molten metal out of the inlet/outlet pipe 5 never occurs and the height of the molten metal flowing into the chamber 2 never exceeds the fluid level 11 in the metal furnace 1, so that cold solidification of the molten metal does not occur in the inlet/outlet pipe 5.

In the description above, when the pressurized gas is introduced into the molten metal chamber 2 as indicated by an arrow 10, the molten metal flows in the feed pipe 3, as indicated by arrows 12, 13 and 14, to a specified place as shown in FIG. 1. In this case, a static pressure corresponding to the level difference between the junction part of the top end of the fluid suction pipe 4 and the feed pipe 3 and the fluid level 11 is exerted on the junction part of the top end of the suction pipe 4 and the feed pipe 3, on the contrary a pressure should be imparted to the chamber 2 to elevate the molten metal to the highest level of the feed pipe 3. Accordingly, the pressure in the molten metal chamber 2 must be higher than that inside the junction part of the top end of the suction pipe 4 and the feed pipe 3 by a differential pressure corresponding to hi in FIG. 1. However, since the molten metal in the fluid feed pipe 3 flows as indicated by an arrow 12 by pressurizing inside the molten metal chamber 2, the pressure inside the junction part of the suction pipe 4 is never increases up to the differential pressure corresponding to h1 in FIG. 1. Namely, in a case when the molten metal begins to flow, as indicated by an arrow 12, through the fluid feed pipe 3 by increasing the differential pressure between the molten metal chamber 2 and the fluid suction pipe 4 up to hi in FIG. 1, the flow of the molten metal in the fluid feed pipe 3 particularly accelerates the flow rate at the junction part between the top of the fluid suction pipe 4 and feed pipe 3, so that backflow of the molten metal toward the suction pipe 4 is reduced while maintaining a pressure balance of the inside of the junction part of the suction pipe 4.

Figure 2:
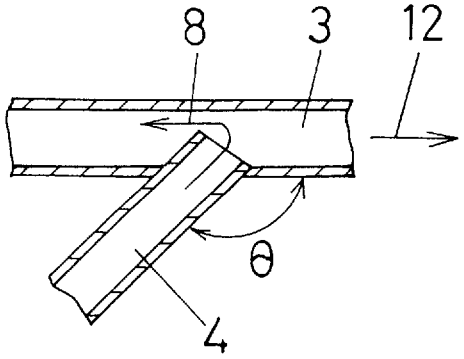
FIG. 2 is an enlarged sectional view illustrating a junction part between a fluid feed pipe and a fluid suction pipe in the embodiment of FIG. 1.

In order to readily attain this pressure balance, an angle θ formed between the fluid suction pipe 4 and feed pipe 3 at their junction part is selected to be an obtuse angle projecting on the direction of the molten metal transfer as shown in FIG. 1. Also, as shown in FIG. 2, by arranging a smaller cross-sectional area of the fluid feed pipe 3 at the junction part between the top of the fluid suction pipe 4 and feed pipe 3 than the cross-sectional area at other parts of the fluid feed pipe 3, a means to accelerate the flow rate of the molten metal at the junction part can be adopted. When transfer of the molten metal is commenced under a pressurized state of the molten metal chamber 2, by adopting the before described measures such as maintaining the pressure balance of the molten metal inside the junction part of the fluid suction pipe 4, the backflow of the molten metal toward the fluid suction pipe 4 can be efficiently prevented.

Other measures such as a choice of larger cross-sectional area of the fluid feed pipe 3 than the cross-sectional area of the fluid suction pipe 4 are also conceivable; however, if rather smaller cross-sectional area of the suction pipe 4 is adopted beyond its requirement, it takes a long time to affect the automatic suction on the molten metal to let it flow into the molten metal chamber 2 (i.e. lower suction rate), resulting in a longer interval of the intermittent transfer of the molten metal via and through the chamber 2 (metal furnace 1—suction pipe 4—molten metal chamber 2 and then molten metal chamber 2—fluid feed pipe 3—specific position). Accordingly, as far as the pressure balance is conserved, no large difference in the diameter between pipes 3 and 4 is preferable.

In the description above, after the flow of the molten metal, as indicated by arrows 12, 13 and 14, has been commenced through the fluid feed pipe 3 from the molten metal chamber 2, a slight amount of the molten metal, which once flowed backward into the fluid suction pipe 4 at the onset of the transfer flow, may be sucked toward the direction as indicated by an arrow 12, driven by the flow of the molten metal in the same direction through the fluid feed pipe 3 at the junction part between the fluid suction pipe 4 and feed pipe 3. Accordingly, provided that the bottom of the metal furnace and the top end of the fluid feed pipe 3 are kept at almost the same level (as indicated by a dotted line in FIG. 1), a continuous transfer from the metal furnace 1 to the specific position through the suction pipe 4 and feed pipe 3 can be obtained after the transfer of the molten metal from the chamber 2 to the specific position through the feed pipe 3 has been commenced, as long as some molten metal remains inside the metal furnace 1.

EXAMPLE 2

Figure 3:
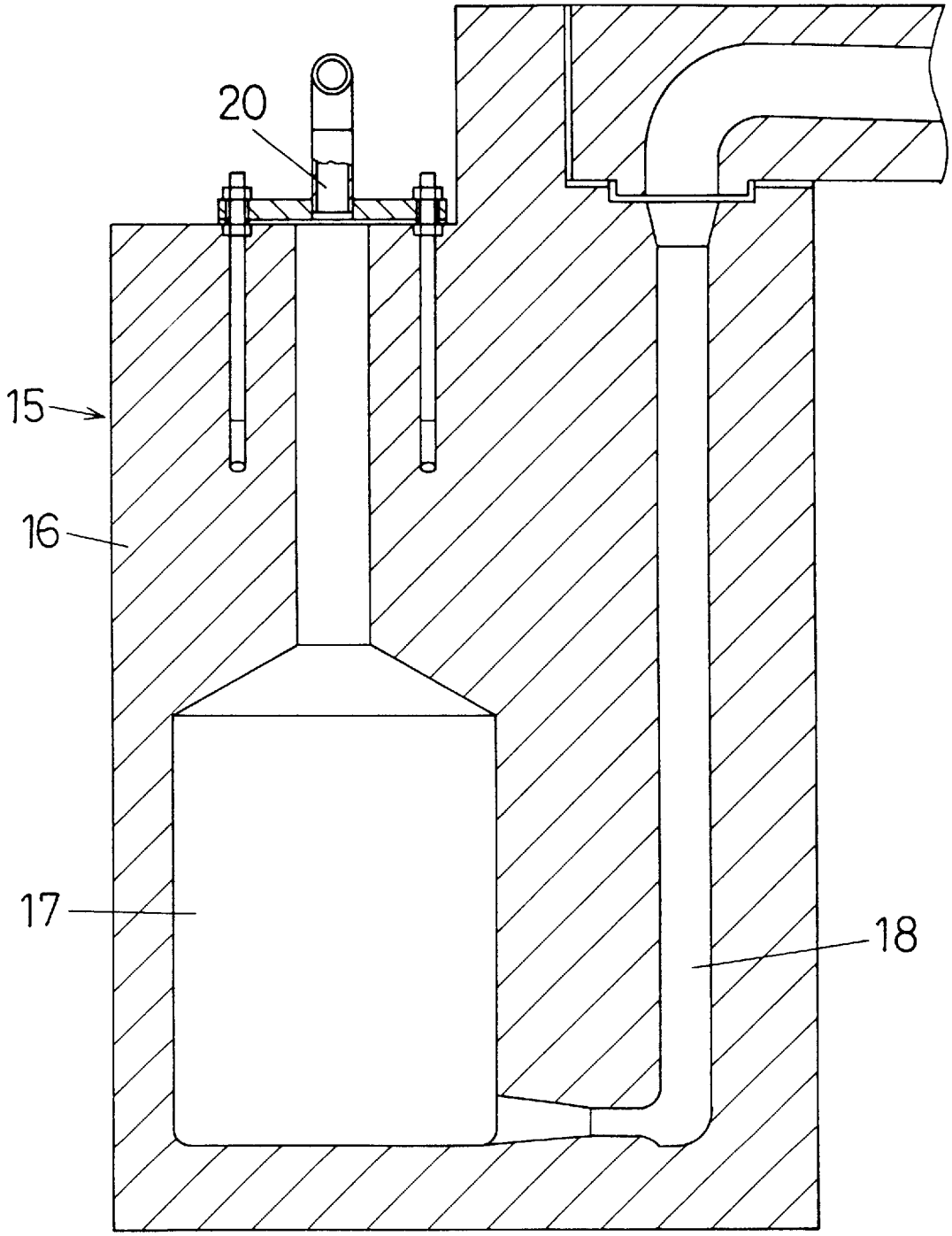
FIG. 3 is a sectional view illustrating a second embodiment of the present invention.
Figure 4:
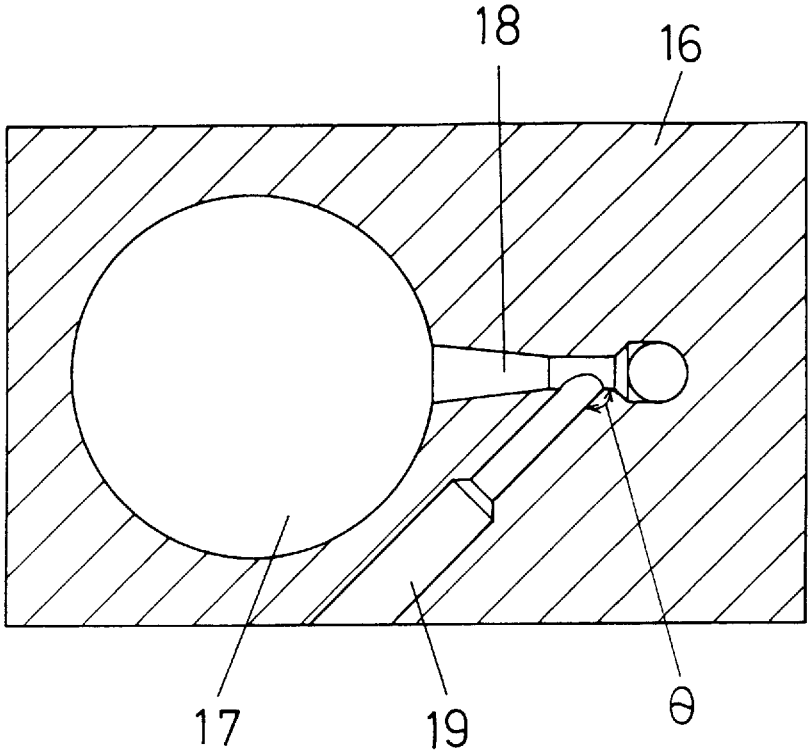
FIG. 4 is a cross-sectional plan view illustrating the embodiment of FIG. 3.

The embodiment illustrated in FIGS. 3 and 4 indicates a molten metal transfer apparatus 15 used for molten metal at high temperatures (e.g. molten aluminum as an example). Namely, a molten metal chamber 17, a fluid feed pipe 18, a fluid suction pipe 19 and inlet/outlet pipe 20 are included in a ceramic-made block 16. Since transfer of the molten metal and the like in this embodiment are similar to that in the embodiment of EXAMPLE 1, its description is omitted.

As shown in FIG. 4, the fluid suction pipe 19 is horizontally connected to the fluid feed pipe 18 in this embodiment.

Namely, this invention can be justified as far as the way of dealing with connection of the fluid suction pipe 4 to the feed pipe 3 or the fluid suction pipe 19 to the feed pipe 18 is done in consideration of:

1) availability of an automatic suction of the molten metal from the metal furnace 1 to the molten metal chamber 2 driven by atmospheric pressure or the pressure inside the furnace 1 (the flow rate thereof is usually controlled aiming at a half of the transfer rate of the molten metal from the chamber 2), when the pressure inside the chamber 2 is equalized with atmospheric pressure or the pressure inside the metal furnace, and 2) easy availability of a pressure balance of the molten metal inside the junction part of the suction pipe 4 or 19 at the onset of the molten metal transfer from the molten metal chamber 2 or 17.

Accordingly, provided that an open end of the fluid suction pipe 4 or 19 is located towards the transfer direction of the molten metal in the fluid feed pipe 3 or 18 and the angle θ formed at the junction part between the fluid suction pipe 4 or 19 and the feed pipe 3 or 18 is selected to be an obtuse angle projecting on the direction of the molten metal transfer as shown in FIGS. 1, 2 and 4, the fluid suction pipe 4 or 19 and the feed pipe 3 or 18 can be corrected in at any direction no matter whatever vertical or horizontal direction is selected.

EXAMPLE 3

Figure 5:
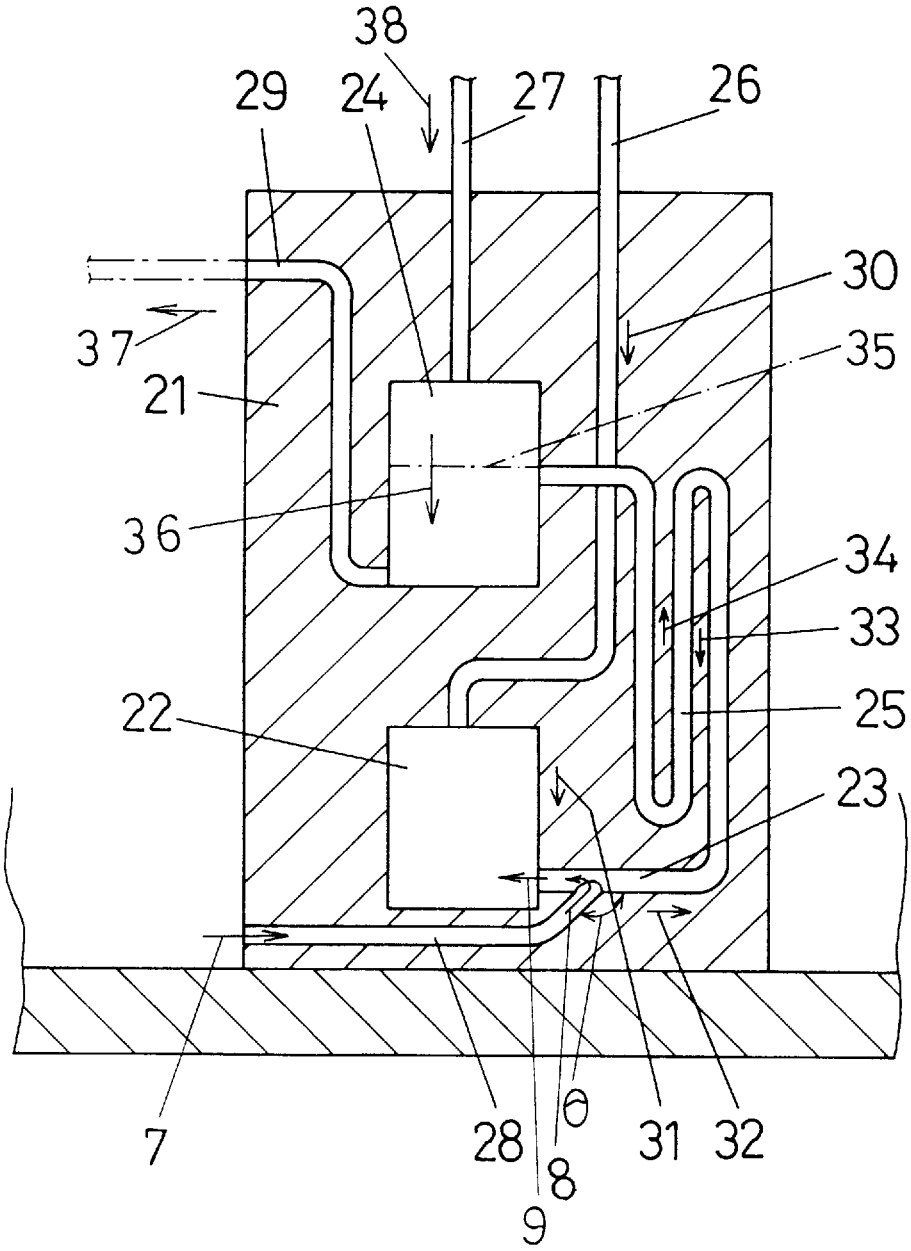
FIG. 5 is a sectional view illustrating a third embodiment of the present invention.

The embodiment illustrated in FIG. 5 is an example of the quantitative transfer of molten metal. In this embodiment, a predetermined amount of molten metal is transferred at predetermined intervals.

In FIG. 5, a molten metal chamber 22 is installed at the lower part of a ceramics-made block 21, the base part of a fluid feed pipe 23 is connected to the lower part of a molten metal chamber 22, a quantitative chamber 24, which has a predetermined volume, is installed at the upper part of the foregoing molten metal chamber 22. A top end of foregoing fluid feed pipe 23 is connected to the middle part of the quantitative chamber 24 and an U-shape tube 25 is installed between the top and base ends of the fluid feed pipe at the middle part of the fluid feed pipe 23 as shown in FIG. 5. Gas inlet/outlet pipes 26, 27 are connected to the upper parts of the foregoing molten metal chamber 22 and quantitative chamber 24 respectively, and a fluid suction pipe 28 is diagonally connected to the base part of the foregoing fluid feed pipe 23. A discharge pipe 29 is connected to the chamber 22 as shown in FIG. 5.

In the embodiment mentioned above, when the molten metal chamber 22 is charged with a pressurized gas (e.g. nitrogen gas) as indicated by an arrow 30, the fluid level in the molten metal chamber 22 is depressed as indicated by an arrow 31, and consequently the molten metal enters the quantitative chamber 24 through the fluid feed pipe 23 and the U-shape tube 25 as indicated by arrows 32, 33 and 34. Then, when the pressurized gas (e.g. nitrogen gas) is introduced through the inlet/outlet pipe 27 as indicated by an arrow 38, the entered molten metal flows backwards into the fluid feed pipe 23 until the fluid level in the quantitative chamber 24 reaches a line 35 in FIG. 5. The pressurized gas depresses the fluid level in the chamber 24 as indicated by an arrow 36, so that the molten metal is transferred to a specific place through the discharge pipe 29 as indicated by an arrow 37. In this case, the quantity of the molten metal in the quantitative chamber 24 below the line 35 (FIG. 5) is a constant volume, so that a fixed quantity of the molten metal can be transferred at predetermined intervals.

Since the U-shape tube 25 has been installed in the description above and as shown in FIG. 5, however the fluid level inside the U-shape tube 25 is depressed by the pressurized gas toward the base part of the fluid feed pipe 23, the pressurized gas will never flows backward to the base part of the pipe 23 so that the pressurized gas mixes into the molten metal in the furnace.

In this embodiment, provided that the pressure in the molten metal chamber 22 is equalized with atmospheric pressure or the pressure in the metal furnace, the molten metal is automatically sucked into the molten metal chamber 22 through the fluid suction pipe 28 and the feed pipe 23, as indicated by arrows 7, 8 and 9, driven by atmospheric pressure or the pressure in the metal furnace, similarly to the case of the embodiment of EXAMPLE 1. Accordingly, the description of this embodiment with respect to the automatic suction of molten metal from the metal furnace into the chamber 22 through the suction pipe 28 is omitted.

Also, when the molten metal chamber 22 is charged with the pressurized gas (e.g. nitrogen gas) as indicated by an arrow 30 and the transfer of the molten metal from the molten metal chamber 22 to the quantitative chamber 24 commences, the backflow toward the fluid suction pipe 28 can be reduced, being influenced by the flow of the molten metal in the fluid feed pipe 23 as indicated by an arrow 32, particularly influenced by the accelerated flow rate of the molten metal at the junction part between the fluid suction pipe 28 and feed pipe 23, while keeping a well balanced pressure of the molten metal inside the junction part of the fluid suction pipe 28. Since these pressures are similar to the case of the embodiment of EXAMPLE 1, description of these processes is omitted.

EXAMPLE 4

The fourth embodiment of the present invention is described with reference to FIG. 6.

In a metal furnace 1, a molten metal chamber 2 is installed. The base part of a fluid feed pipe 3 is open in the neighborhood of the bottom part of chamber 2 and a top end thereof, spanning over a metal furnace 1, is led to a specified place. In a case where a continuous transfer of the molten metal from the furnace 1 to the specific position through the suction pipe 4 and feed pipe 3 is intended, after the transfer of the molten metal from the chamber 2 to the specific position through the feed pipe 3 has been commenced, it can be realized by keeping the top end of the fluid feed pipe 3 at a lower level than the ordinary molten metal surface (such as indicated by a chain line in FIG. 6), as far as the height difference can be maintained.

The upper part of the above-mentioned molten metal chamber 2 is tightly closed and an inlet/outlet pipe 5 of pressurized gas equipped with an automatic valve 6 is connected to the upper wall 2*a* of chamber 2. Although the automatic valve 6 is usually used for feeding and ejecting pressurized gas, it works not only to transfer the molten metal from the molten metal chamber 2 to the specific position through the fluid feed pipe 3 when the pressurized gas is fed through the inlet pipe 5*a* but also to suck the molten metal automatically from the metal furnace 1 to the molten metal chamber 2 through the fluid suction pipe 4 when the pressurized gas is released through the outlet pipe 5*b*.

Namely, by opening the automatic valve 6, the pressurized gas is released outside the outlet pipe 5*b* resulting in a balanced pressure in the molten metal chamber 2 against atmospheric pressure or the pressure in the metal furnace 1, and consequently the molten metal flows automatically into the molten metal chamber 2 through the fluid suction pipe 4 as indicated by arrows 39 and 40. Though the flow rate depends upon the level of the molten metal, it is usually controlled at about half of the transfer rate from the molten metal chamber 2 through the fluid feed pipe 3.

Although the quantity of the sucked molten metal is not precisely known in the description above, if the level of the molten metal 11 varies a little in the metal furnace 1, the quantity of the molten metal in the chamber 2 can be controlled by adjusting the release time of the automatic valve 6. Since the inlet/outlet pipe 5 projects far out of the molten metal surface and the automatic valve 6 is mounted on the projecting part, the molten metal never gushes out from the inlet/outlet pipe 5 and the level of the molten metal flowing into the chamber 2 is never exceeds that in the metal furnace 1, so that cold solidification of the molten metal in the inlet/outlet pipe 5 will not occur.

In the description above, the pressurized gas is fed to the molten metal chamber 2 as indicated by an arrow 41, the molten metal flows inside the fluid feed pipe 3 as indicated by arrows 42, 43 and 44, eventually to a specified place. In this case, a static pressure corresponding to the level difference between the molten metal surface 11 and the lower open end of the fluid suction pipe 4 is exerted on the inside of the fluid suction pipe 4. On the other hand, the molten metal chamber 2 must be pressurized until the molten metal is elevated up to the highest position in the fluid feed pipe 3. Accordingly, the pressure inside the chamber 2 must be maintained higher than that inside the fluid suction pipe 4 by the differential pressure corresponding to h1 in FIG. 6. However, by this pressurization inside the molten metal chamber 2, the molten metal in the fluid feed pipe 3 flows as indicated by an arrow 42 and succeedingly the molten metal, which has been sucked in the molten metal chamber 2, flows into the fluid feed pipe 3 as indicated by an arrow 45, so that the pressure inside the fluid suction pipe 4 no longer indicates the differential pressure corresponding to h1 in FIG. 6. It means that when the molten metal begins to flow, as indicated by arrows 45 and 42, being induced by the differential pressure between the chamber 2 and the suction pipe 4 corresponding to h1 in FIG. 6, the backflow of the molten metal toward the fluid suction pipe 4 can be reduced and the flow of the molten metal from the chamber 2 to the feed pipe 3 yields a pressure balance of the molten metal in the fluid suction pipe 4.

Figure 6:
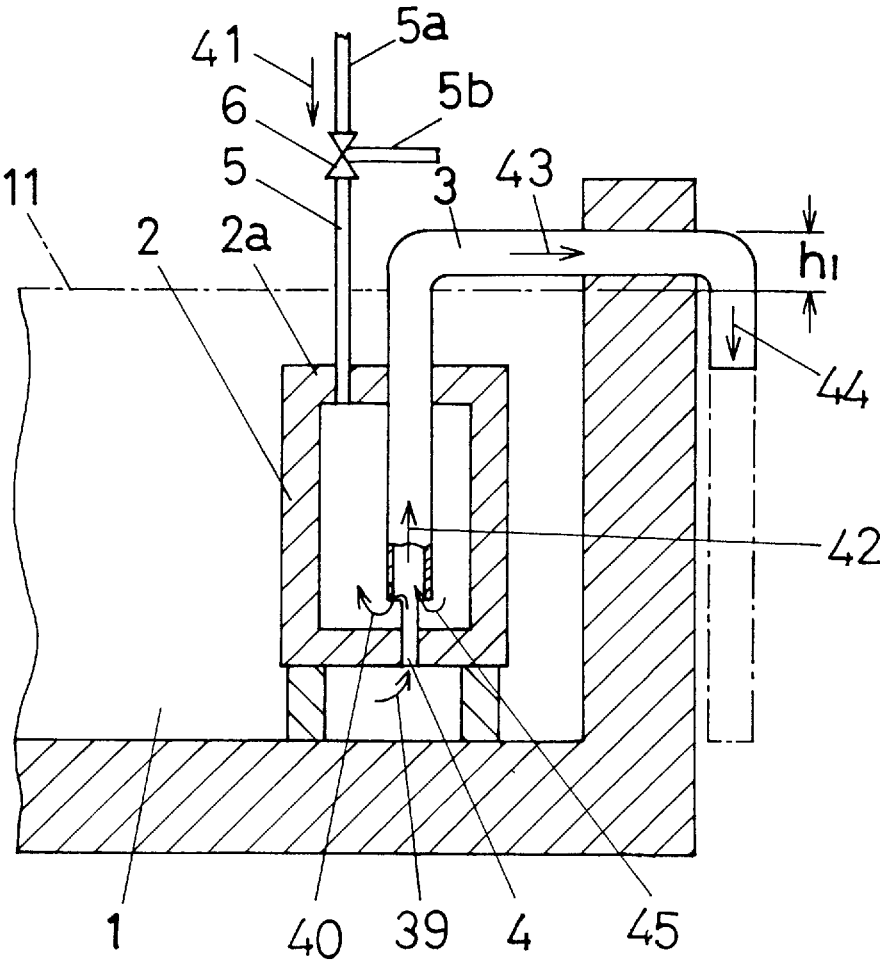
FIG. 6 is a partial sectional view illustrating a fourth embodiment of the present invention.

In order to readily yield such a pressure balance, the following measures can be employed: opposed allocation of the open end of the fluid suction pipe 4 against the open end of the fluid feed pipe 3, smaller diameter of the open end of the fluid suction pipe 4 than the diameter of the open end of the fluid feed pipe 3, extremely neighboring opposed allocation of open end of the fluid suction pipe 4 against open end of the fluid feed pipe 3, and pipe 4 with smaller diameter than the diameter of the fluid feed pipe 3 opposed against open end of the fluid feed pipe 3 as shown in FIG. 6. By employing these measures, when the molten metal flows from the molten metal chamber 2 to the fluid feed pipe 3 as indicated by arrows 45, 42 and 43, the flow rate at the position where the open end of the fluid suction pipe 4 is opposed against open end of the fluid feed pipe 3 is accelerated and the pressure balance inside the fluid suction pipe 4 can be achieved. Consequently, at the onset of the transfer of molten metal by pressurizing the molten metal chamber 2, the backflow of the molten metal toward the fluid suction pipe 4 can be effectively prevented by the before described accelerated flow at the position where the open end of the fluid suction pipe 4 is opposed against the open end of the fluid feed pipe 3.

As described above, one of measures yields the pressure balance is a choice of larger cross-sectional area of the fluid feed pipe 3 than the cross-sectional area of the fluid suction pipe 4. But, if an extremely small cross-sectional area is chosen for the fluid suction pipe 4, it takes a long time to automatically suck the molten metal into the molten metal chamber 2 from the metal furnace (resulting in a low suction rate) and results in a long interval for intermittent transfer of the molten metal via and through the molten metal chamber 2. It is preferable that no large difference exists between diameters of both pipes, as far as the pressure balance is conserved.

According to the experiments carried out by the inventor of the present invention, it was clarified that the cross-sectional area of the fluid suction pipe 4, selected to be less than a half of that of the feed pipe 3, was the most effective from a view point of the transfer efficiency of the molten metal.

In the description above, it is said that at the time when the flow of molten metal is commenced from the molten metal chamber 2 through the fluid feed pipe 3 as indicated by arrows 45, 42, 43 and 44, a slight amount of backflow of the molten metal occurs towards the fluid suction pipe 4, but, thereafter, it is sucked at the opposed part of the fluid suction pipe 4 against the feed pipe 3 by the flow from the molten metal chamber 2 to the fluid feed pipe 3 as indicated by arrows 45 and 42. Accordingly, after the transfer of the molten metal from the chamber 2 has been commenced, provided the bottom part of the metal furnace and the top end of the fluid feed pipe 3 are allocated at nearly the same level (indicated by a dotted line in FIG. 6), a continuous transfer is feasible as far as some molten metal remains in the metal furnace 1.

EXAMPLE 5

Figure 7:
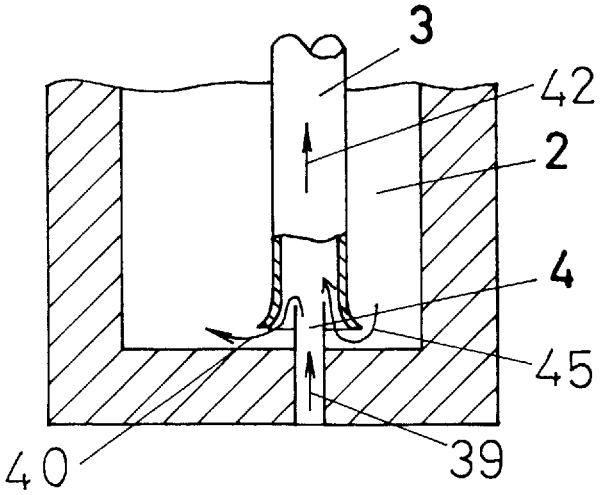
FIGS. 7(*a*), 7(*b*) and 7(*c*) are enlarged sectional views illustrating an example in which the allocations of an open end of the fluid feed pipe and an open end of the fluid suction pipe in the embodiment of FIG. 6 are varied, wherein FIG. 7 (*a*) illustrates an embodiment in which the fluid suction pipe is inserted into the fluid feed pipe, FIG. 7 (*b*) illustrates an embodiment in which an open end of the fluid feed pipe and an open end of the fluid suction pipe are elevated to a higher level than the bottom of the molten metal chamber, and FIG. 7 (*c*) illustrates an embodiment in which an open end of the fluid feed pipe is directed horizontally.
Figure 7:
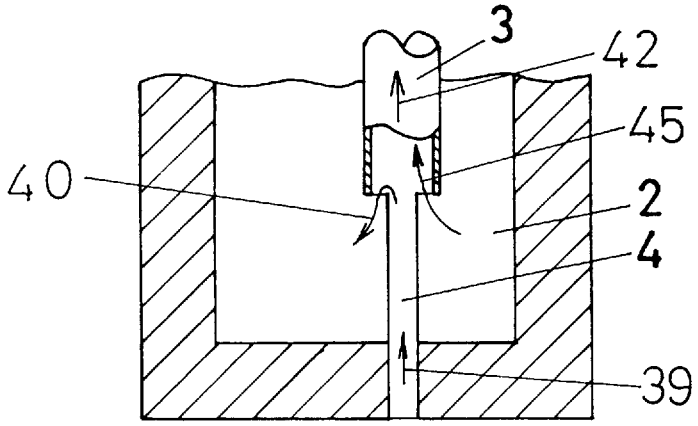
Figure 7:
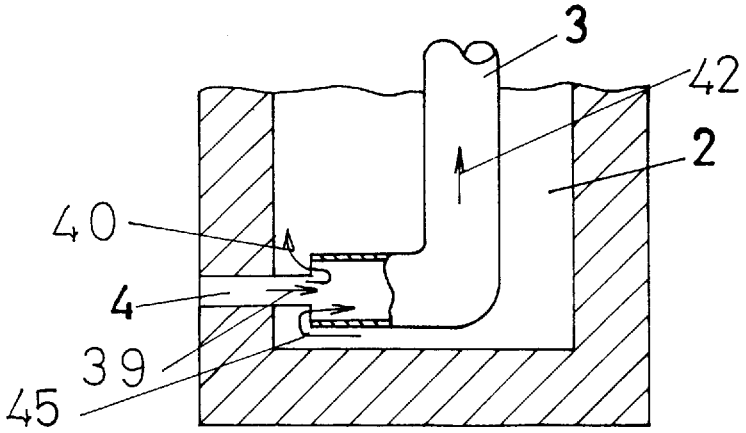

FIGS. 7 (*a*), 7 (*b*) and 7 (*c*) illustrate various opposed positions of an open end of the fluid feed pipe 3 relative to that of the fluid suction pipe 4, adding some variations on FIG. 6 depicted in the previous embodiment of EXAMPLE 4, i.e., FIG. 7 (*a*) illustrates an example where an open end of the fluid suction pipe 4 is slightly inserted into an open end of the fluid feed pipe 3, FIG. 7 (*b*) illustrates an example where an open end of the fluid suction pipe 4 is elevated to a high level corresponding to an open end of the fluid feed pipe 3, and FIG. 7 (*c*) illustrates an example where an open end of the fluid suction pipe 4 is installed beside a laterally-bent open end of the fluid feed pipe 3.

In the embodiment example of FIG. 7 (*a*), the diameter of an open end of the fluid feed pipe 3 is larger than that of other parts thereof, so that the pressure inside the molten metal chamber 2 can be equalized with atmospheric pressure or the pressure inside the metal furnace, taking account of a smooth flow of the molten metal in the metal furnace toward the chamber 2 through the fluid suction pipe 4 as indicated by an arrow 40, motivated by the automatic suction process. Accordingly, in this example it is also possible, if necessary, to equalize the diameter of an open end of the fluid feed pipe 3 with that of other parts thereof as shown in other examples.

In either the examples of FIGS. 7 (*a*), 7 (*b*) or 7 (*c*) illustrated above, the automatic suction flow of the molten metal from the metal furnace 1 to the chamber 2 through the suction pipe 4 and the transferring flow of the molten metal from the chamber 2 through the feed pipe 3 are achieved by controlling the pressure balance in the molten metal chamber 2, the case of embodiment EXAMPLE 4 is noticed to be most favorable.

EXAMPLE 6

In the embodiment described in EXAMPLE 5, a case where the molten metal chamber 2 is installed dipping into the molten metal furnace 1 has been cited.

Figure 8:
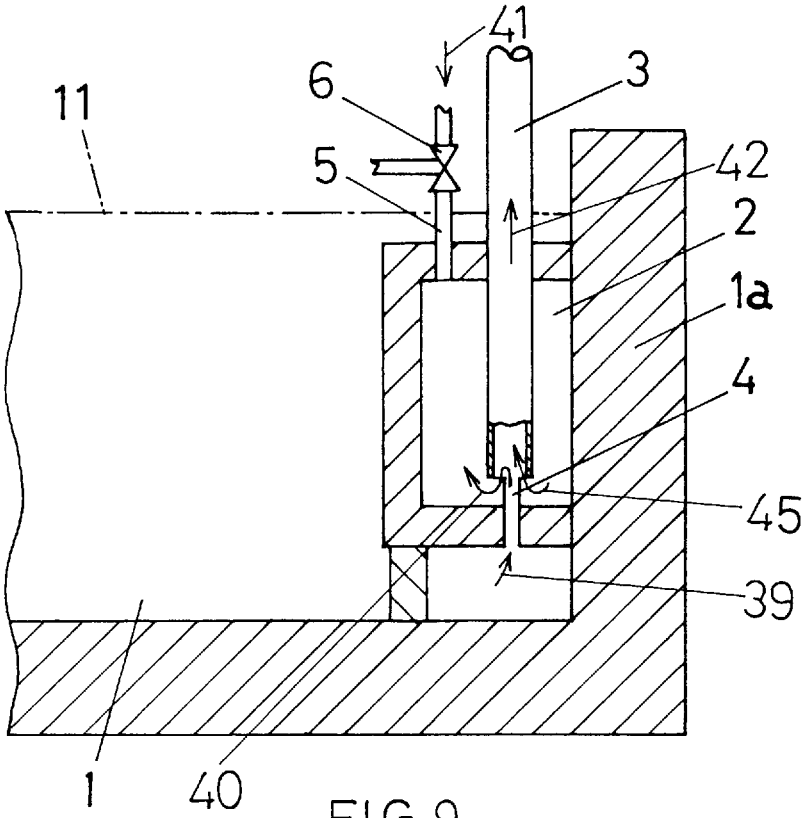
FIG. 8 is a partially enlarged sectional view illustrating a fifth embodiment of the present invention.

FIG. 8 illustrates a case where the molten metal chamber 2 is installed utilizing a side wall 1*a* of the metal furnace 1 for one of the side wall of the chamber. In this case, since the mutual relationship of the fluid feed pipe 3 and suction pipe 4 is the same as the EXAMPLE 5, description of their implementation and operational effects are omitted. In FIG. 8, fluid feed pipe, inlet/outlet pipe of pressurized gas, automatic valve and molten metal surface are indicated by reference numerals 3, 5, 6 and 11, respectively.

EXAMPLE 7

Figure 9:
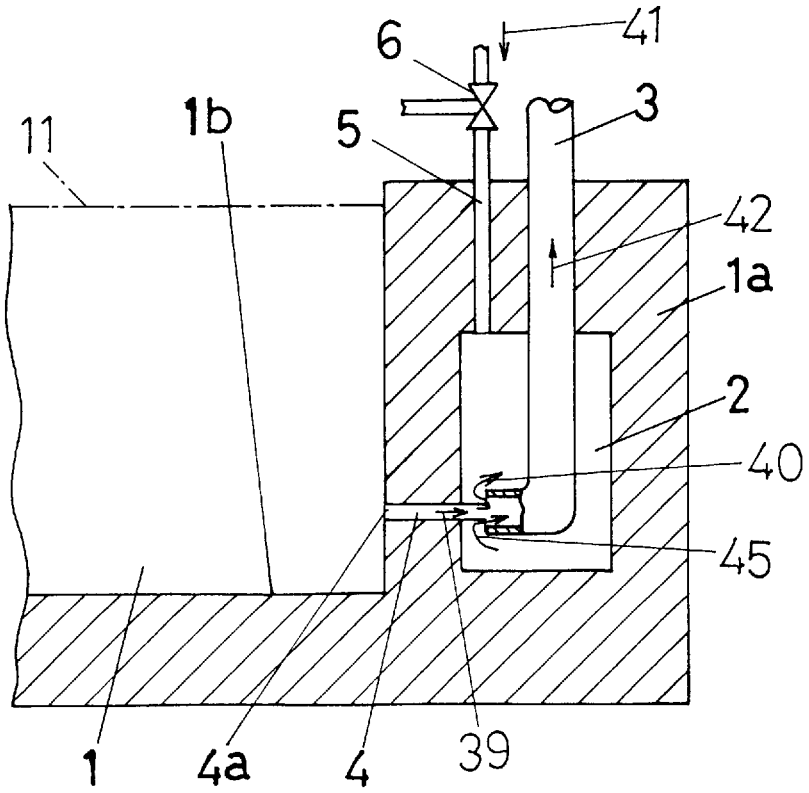
FIG. 9 is a partially enlarged sectional view illustrating a sixth embodiment of the present invention.

The embodiment of FIG. 9 is a case where the molten metal chamber 2 is embedded or formed inside a wall 1*a*of the metal furnace 1. Since the embodiment shown in FIG. 9 is the same as the embodiment of FIGS. 6 and 8 except that the base open end 4*a* of the fluid suction pipe 4 is installed in the vicinity of the furnace bottom 1*b*, descriptions of their implementation and operational effects are omitted. In FIG. 9, fluid feed pipe, inlet/outlet pipe of pressurized gas, automatic valve and molten metal surface are indicated by reference numerals 3, 5, 6 and 11, respectively.

Although the present invention has been described fully with reference to the particular preferred embodiments thereof, it should be understood that various changes and modifications may be made without departing from the spirit and scope of the invention as defined in the appended claims.

What is claimed is:

1. A method of transferring molten metal comprising:

sucking molten metal automatically through a fluid suction pipe from a metal furnace into a molten metal chamber, said molten metal chamber being installed in said metal furnace and said fluid suction pipe being connected to a base part of a fluid feed pipe which is connected to a lower part of said molten metal chamber, wherein said sucking of molten metal is accomplished due to a pressure balance; and feeding pressurized gas into said molten metal chamber through an upper portion thereof in order to transfer the molten metal contained therein through said fluid feed pipe to a specified position.

2. The method as claimed in claim 1, wherein during the transfer of the molten metal, a flow rate of the molten metal at a junction between said fluid feed pipe and said fluid suction pipe is higher than at other parts of said fluid feed pipe.

3. A molten metal transfer method comprising:

delivering molten metal from a metal furnace into a molten metal chamber via a fluid suction pipe having an open end which extends into a lower portion of said molten metal chamber;

transferring the molten metal in said molten metal chamber, by a balanced pressure inside of said molten metal chamber, through a fluid feed pipe having an open inlet end which extends into said molten metal chamber, wherein said open end of said fluid suction pipe is disposed so as to oppose said open inlet end of said fluid feed pipe such that said open end of said fluid suction pipe is located at the same level as said open end of said fluid feed pipe or said open end of said fluid suction pipe is inserted into said open inlet end of said fluid feed pipe.

4. A molten metal transfer apparatus comprising:

a metal furnace;

a molten metal chamber disposed in said metal furnace, said molten metal chamber having a closed upper portion and a lower portion;

a pressurized gas inlet/outlet pipe having a first end communicating with said molten metal chamber through said closed upper portion of said molten metal chamber;

a fluid feed pipe in fluid communication with said molten metal chamber, said fluid feed pipe having a base portion connected to said lower portion of said molten metal chamber; and a fluid suction pipe having a first open end connected to said base portion of said fluid feed pipe and extending from said fluid feed pipe in a direction towards said molten metal chamber such that said fluid suction pipe and said fluid feed pipe form an obtuse angle, and said fluid suction pipe having a second open end disposed adjacent a lower part of said metal furnace, wherein said first open end of said fluid suction pipe is directed away from said molten metal chamber.

5. The molten metal transfer apparatus as claimed in claim 4, wherein said molten metal transfer chamber is embedded within a wall of said metal furnace, dipped into said metal furnace, or connected separately to an interior surface of said metal furnace.

6. A molten metal transfer apparatus comprising:

a metal furnace;

a molten metal chamber disposed in said metal furnace, said molten metal chamber having a closed upper portion and a lower portion;

a pressurized gas inlet/outlet pipe having a first end communicating with said molten metal chamber through said closed upper portion of said molten metal chamber;

a fluid feed pipe in fluid communication with said molten metal chamber, said fluid feed pipe having a base portion connected to said lower portion of said molten metal chamber; and a fluid suction pipe having a first open end and a second open end, said first open end being connected to said base portion of said fluid feed pipe at a junction, and said second open end being disposed adjacent a lower portion of said metal furnace, wherein said fluid feed pipe has a reduced cross-sectional area at said junction between said fluid suction pipe and said fluid feed pipe in relation to cross-sectional areas at other locations of said fluid feed pipe so as to create a venture effect at said junction.

7. The molten metal transfer apparatus as claimed in claim 6, wherein said molten metal transfer chamber is embedded within a wall of said metal furnace, dipped into said metal furnace, or connected separately to an interior surface of said metal furnace.

8. A molten metal transfer apparatus comprising:

a metal furnace;

a molten metal chamber disposed in said metal furnace, said molten metal chamber having a closed upper portion and a lower portion;

a pressurized gas inlet/outlet pipe having a first end communicating with said molten metal chamber through said closed upper portion of said molten metal chamber;

a fluid feed pipe in fluid communication with said molten metal chamber, said fluid feed pipe having a base portion connected to said lower portion of said molten metal chamber; and a fluid suction pipe having a first open end and a second open end, said first open end of said fluid suction pipe being connected to said base portion of said fluid feed pipe and directed toward a molten metal transferring direction through said fluid feed pipe, and said second open end of said fluid suction pipe being disposed adjacent a lower portion of said metal furnace, wherein said fluid suction pipe has an inner diameter which is less than an inner diameter of said fluid feed pipe.

9. The molten metal transfer apparatus as claimed in claim 8, wherein said molten metal transfer chamber is embedded within a wall of said metal furnace, dipped into said metal furnace, or connected separately to an interior surface of said metal furnace.

10. A molten metal transfer apparatus comprising:

a metal furnace;

a molten metal chamber disposed on a bottom wall of said metal furnace, on a side wall of said metal furnace, or embedded in a wall of said metal furnace, said molten metal chamber having a closed upper portion and a lower portion;

a pressurized gas inlet/outlet pipe communicating with said molten metal chamber through said closed upper portion of said molten metal chamber;

a fluid feed pipe having a first open end in fluid communication with said molten metal chamber; and a fluid suction pipe having a first open end extending into said molten metal chamber and opposing said first open end of said fluid feed pipe, wherein said first open end of said fluid suction pipe is located at the same level as said open end of said fluid feed pipe or said first open end of said fluid suction pipe is inserted into said first open end of said fluid feed pipe.

11. The molten metal transfer apparatus as claimed in claim 10, wherein said first open end of said fluid suction pipe has a smaller cross-sectional area than said cross-sectional area of said first open end of said fluid feed pipe.

12. The molten metal transfer apparatus as claimed in claim 11, wherein said cross-sectional area of said fluid suction pipe is half or less than said cross-sectional area of said fluid feed pipe.

* * * * *